US006833669B2

(12) United States Patent
George et al.

(10) Patent No.: US 6,833,669 B2
(45) Date of Patent: Dec. 21, 2004

(54) METHOD AND APPARATUS FOR MAKING LARGE-SCALE LAMINATED FOIL-BACK ELECTROLUMINESCENT LAMP MATERIAL, AS WELL AS THE ELECTROLUMINESCENT LAMPS AND STRIP LAMPS PRODUCED THEREFROM

(75) Inventors: Douglas A. George, Watertown, CT (US); Gustaf T. Appelberg, Fairfield, CT (US)

(73) Assignee: E-Lite Technologies, Inc., Trumbull, CT (US)

( * ) Notice: Subject to any disclaimer, the term of this patent is extended or adjusted under 35 U.S.C. 154(b) by 77 days.

(21) Appl. No.: 09/888,954

(22) Filed: Jun. 25, 2001

(65) Prior Publication Data

US 2002/0195931 A1 Dec. 26, 2002

(51) Int. Cl.[7] ..... H01J 1/62

(52) U.S. Cl. ..... 313/506; 313/498; 313/509; 313/511; 427/66

(58) Field of Search ..... 313/498, 506, 313/509, 511; 427/66; 428/917, 690, 212; 315/169.3

(56) References Cited

U.S. PATENT DOCUMENTS

| | | | | |
|---|---|---|---|---|
| 4,534,743 A | | 8/1985 | D'Onofrio et al. | |
| 4,560,902 A | * | 12/1985 | Kardon | 313/509 |
| 4,767,679 A | * | 8/1988 | Kawachi | 428/690 |
| 4,956,031 A | * | 9/1990 | Mori et al. | 313/509 |
| 5,019,748 A | | 5/1991 | Appelberg | |
| 5,045,755 A | * | 9/1991 | Appelberg | 313/498 |
| 5,229,628 A | * | 7/1993 | Kobayashi et al. | 313/509 |
| 6,107,735 A | * | 8/2000 | Hora | 313/506 |

* cited by examiner

*Primary Examiner*—Nimeshkumar D. Patel
*Assistant Examiner*—Sharlene Leurig
(74) *Attorney, Agent, or Firm*—Ware, Fressola, Van Der Sluys & Adolphson LLP

(57) ABSTRACT

Continuous manufacturing of EL lamp laminate material comprising a front substrate made up of an organic binder phosphor particulate layer coated on an ITO/PET substrate with a rear substrate made up of a barium titanate layer coated on an aluminum foil polyester film laminate is described. The resultant EL lamp laminate is coiled and stored on a take-up reel for subsequent use as an EL lamp having a transparent ITO front electrode and aluminum foil rear electrode. Large surface illumination area, split-electrode and parallel plate EL lamps made from the EL lamp laminate material are also described.

52 Claims, 8 Drawing Sheets

METHOD AND APPARATUS FOR MAKING LARGE-SCALE LAMINATED FOIL-BACK ELECTROLUMINESCENT LAMP MATERIAL, AS WELL AS THE ELECTROLUMINESCENT LAMPS AND STRIP LAMPS PRODUCED THEREFROM

TECHNICAL FIELD

The present invention relates generally to electroluminescent panels and deals more particularly with a method and related apparatus for continuous processing to produce large-scale foil-back electroluminescent lamp material. The invention further relates to split-electrode and parallel plate electroluminescent lamps and strip lamps made from the large-scale foil-back electroluminescent lamp material.

BACKGROUND OF THE INVENTION

Lamps and processes for making individual lamps from electroluminescent material are known in the electroluminescent (EL) lamp art. Typical EL lamps are relatively small in illuminated surface area and are known as "parallel plate lamps" that are produced from a number of processes including screen-printing, lamination and other processes known in the EL lamp art. The generic construction of most EL lamps can be described as being built up layer-by-layer from the front substrate having: 1) a transparent front substrate; 2) a transparent conductive front electrode; 3) a phosphor/organic binder layer; 4) a barium titanate layer and 5) a rear electrode layer formed from a conductive coating such as nickel acrylic or conductive silver ink.

An alternate generic construction uses an aluminum foil substrate to form the rear electrode, in which case there is no front substrate because the lamp is built up layer-by-layer from the rear. Also, in the generic construction described above a portion of the front electrode is not coated with the phosphor/organic binder layer and is left exposed to permit attachment of an electrical connector to the front electrode. Inherently, clear conductors are fragile and cannot support connection and often a conductive ink, such as a silver ink, is used to support the termination and distribute the power applied thereto more evenly.

A disadvantage of EL lamps constructed as described above is the limited size or area that can be powered to maintain uniform brightness across the EL lamp. The transparent front electrode in these EL lamps is characteristically not a perfect conductor and exhibits a significant electrical resistance. This electrical resistance produces voltage drops that manifest as decreasing and lower relative brightness as the distance from the point of power connection increases. An EL lamp with a continuous silver conductor around its periphery is often used to obtain shorter connection distances to distribute current in a parallel plate EL lamp in an attempt to overcome the effects of voltage drops; however, the center of the EL lamp will become lower in brightness compared to the brightness at the periphery as the lamp area size increases.

D'Onofrio (U.S. Pat. No. 4,534,743) discloses a process for continuously manufacturing flexible electroluminescent lamps by applying the materials throughout the course of the process on a carrier strip, which carrier strip itself becomes part of the lamp and wherein the termination method does not use the front electrode. In the '743 patent, the rear electrode is scored or "scribed" into two substantially equal areas so that the rear electrode areas are electrically isolated from each other. The terminations are then subsequently placed on the two rear electrode halves and connected to an AC voltage or power source. This type of construction is known as a "split-electrode" EL lamp construction and the two rear electrode areas function electrically as a voltage divider, therefore twice the normal operating voltage is required compared to a "parallel plate" EL lamp construction to achieve the equivalent brightness. The brightness, however, in a split-electrode EL lamp is obtained at a reduced current. The primary advantage of a split-electrode EL lamp compared to a parallel plate EL lamp is that most of the current, particularly for large surface area EL lamps, is distributed through the more conductive rear electrodes, which may be, for example, nickel acrylic paint or conductive silver ink. The front transparent electrode, typically indium tin oxide (ITO), carries a small amount of the current, which only powers a local region of the EL lamp. The "split electrode" construction allows the fabrication of larger surface area EL lamps before any reduction in brightness occurs. A further advantage of the "split electrode" construction is the ability to utilize higher volume and automated manufacturing techniques, particularly web-to-web processing, than would otherwise be possible with other EL lamp constructions which are built to a given specification provided beforehand. That is, continuous rolls of EL lamp material can be coated using standard converting equipment, which provides the advantage that the specific lamp size does not have to be predefined prior to the manufacturing of a roll of EL lamp material.

U.S. Pat. No. 5,019,748, assigned to the same assignee as the present invention, discloses a method for making an electroluminescent panel in a continuous fashion using a continuously moving carrier strip that becomes part of the electroluminescent panel or lamp to provide a highly reflective rear electrode that may be split in accordance with the "split-electrode" construction techniques described in U.S. Pat. No. 4,534,743. The method described in the '748 patent for making the electroluminescent panel includes depositing a reflective metallic layer on a smooth finished surface dielectric layer to provide a highly reflective rear electrode. The high reflectivity is a result of controlling the smoothness gloss of the second cured dielectric adhesive layer which causes significantly increased reflectivity of light from the rear to the front of the lamp in operation. The carrier strip can then be coiled after the lamp layers are formed thereon for subsequent payout in a production line that may, for example, die cut lamp shapes from the coil and split the rear electrode. Attachment of electrical conductors to the split rear electrode areas is then made for example, as disclosed in U.S. Pat. No. 5,045,755, assigned to the same assignee as the present invention. Although the '748 patent describes a method for making an EL lamp using an ultraviolet (UV) curable binder and electrostatic deposition of phosphor particles to provide an EL lamp that is superior to the EL lamp production methods and EL lamps of the prior art, the lamp produced in accordance with the method of the '748 patent is not entirely satisfactory. The EL lamp produced in accordance with the '748 patent requires two separate coating and curing operations for the binder to encapsulate the phosphor particles, which are electrostatically deposited in a separate operation and a further third coating and curing operation to add a rear electrode. The structure thus produced is more costly than it need be resulting from the numerous separate operations required to produce the EL lamp material. Additionally, the EL lamp so manufactured has some performance limitations as well. These limitations may be manifested as lower total brightness resulting from a thick second binder coating and lack of rear barium titanate to impedance layer, and limited overall total size due to limited conductivity of the rear electrode.

Accordingly, it is an object of the present invention to reduce the cost of manufacturing EL lamp material by reducing the number of process steps in production.

It is a further object of the present invention to improve the performance of the EL lamp itself made from the EL lamp material by increasing its brightness and substantially removing limitations in the size or surface area of an EL lamp.

It is yet a further object of the present invention to provide apparatus for the continuous production of two primary substrates that are laminated together to create the large-scale foil-back EL lamp material in continuous rolls.

It is a still further object of the present invention to provide an improved foil-back EL lamp material and an EL lamp that reduces the time to make a product by eliminating registration and artwork requirements.

It is an additional object of the present invention to provide an EL lamp material that facilitates handling and is capable of "split-electrode," "parallel plate," and "special effect" EL lamp construction.

It is a yet further object of the present invention to provide an EL lamp of a desired arbitrary size and shape to be cut from a continuous roll of EL lamp material.

SUMMARY OF THE INVENTION

In a broad aspect, the invention relates to a method for continuously manufacturing EL lamp material. The method includes coating an indium tin oxide polyester film (ITO/PET) substrate with a layer of phosphor particulate embedded in an organic binder defining a front substrate, coating an aluminum foil polyester film laminate with a layer of barium titanate defining a rear substrate, and then continuously laminating the front substrate and the rear substrate with the organic binder phosphor particulate layer facing the barium titanate layer to produce an EL lamp laminate material having an ITO front electrode and an aluminum foil rear electrode.

The method further includes coating the ITO surface of the ITO/PET substrate with a UV-curable organic binder prior to electrostatically depositing a layer of phosphor particulate on the UV-curable organic binder surface wherein the phosphor particulate is partially embedded in the organic binder. The UV-curable organic binder phosphor particulate layer is then set to a predetermined desired thickness.

The method further includes curing the UV-curable organic binder phosphor particulate layer prior to laminating the front and rear substrates.

The method further includes partially curing the UV-curable organic binder phosphor particulate layer prior to setting the thickness of the layer.

The method alternatively includes coating the ITO surface of the ITO/PET substrate with a slurry mixture of a UV-curable organic binder and phosphor particulate and then setting the thickness of the UV-curable organic binder and phosphor particulate layer to a predetermined desired thickness.

Further, the UV-curable organic binder phosphor particulate layer is cured prior to the step of laminating the front and rear substrates or the UV-curable organic binder phosphor particulate layer may be wet and cured after the step of laminating the front and rear substrates. Exposed portions of the phosphor particulate extending beyond the surface of the organic binder are fully covered and embedded in the barium titanate layer during the laminating process.

The thickness of the EL lamp laminate material is set to a predetermined desired thickness during lamination of the front and rear substrates.

The method alternatively includes coating the ITO surface of the ITO/PET substrate with a thermoplastic clear organic binder which is set to a predetermined desired thickness. The thermoplastic organic binder layer is warmed to soften it and then a layer of phosphor particulate is electrostatically deposited on the softened thermoplastic organic binder surface. The thermoplastic organic binder phosphor particulate layer is chilled to firm it on the ITO/PET substrate prior to laminating it with the rear substrate.

A further aspect of the invention relates to apparatus for continuously manufacturing EL lamp laminate material. The apparatus includes means for coating a continuous coil of an indium tin oxide polyester film (ITO/PET) substrate with a layer of an organic binder; means for depositing phosphor particulate on the organic binder, wherein the phosphor particulate organic binder coated ITO/PET substrate defines a front substrate; means for coating a continuous coil of an aluminum foil polyester film with a barium titanate layer, wherein the barium titanate coated aluminum foil polyester film defines a rear substrate; and means for laminating the front substrate and the rear substrate with the organic binder phosphor particulate layer facing the barium titanate layer to produce an EL lamp laminate material having an ITO front electrode and an aluminum foil rear electrode.

The ITO/PET coating means further includes a gravure roller for direct or indirect application of the organic binder layer to the ITO surface. The organic binder may be a UV-curable organic binder.

The phosphor particulate depositing means further includes electrostatic depositing means. A calender roll is used to set the thickness of the front substrate to a predetermined desired thickness.

Alternatively, the ITO/PET coating means may be a knife-over-roll apparatus for applying a slurry mixture of a UV-curable organic binder and phosphor particulate to the ITO surface.

The UV-organic binder curing means may be located prior to or after the laminating means. The laminating means includes a pressure-nip laminator or a heated-nip laminator.

A further aspect of the invention relates to a method for continuously manufacturing EL lamp material. The method includes providing a continuous roll of an indium tin oxide coated polyester film ITO/PET substrate of indeterminate length and width. The indium tin oxide surface of the ITO/PET substrate is coated with a UV-curable organic binder layer and a layer of phosphor particles is deposited in the UV-curable organic binder. The phosphor particle UV-curable organic binder layer is partially cured and set to a predetermined desired thickness. The UV-curable organic binder phosphor particle layer is cured, wherein the ITO/PET cured organic binder phosphor particle substrate defines a front electrode substrate. A continuous roll of an aluminum foil polyester film laminate of indeterminate length and having a width substantially equal to the width of the ITO/PET substrate has the aluminum foil surface coated with a barium titanate layer, wherein the barium titanate coated aluminum foil polyester film laminate defines a rear electrode laminate. The front electrode laminate and the rear electrode laminate are continuously joined with the organic binder phosphor particle layer facing the barium titanate layer to produce a continuous roll of EL lamp laminate material.

Further, foreign matter is removed from the indium tin oxide surface prior to coating with the UV-curable organic binder layer. The UV-curable organic binder layer is coated onto the indium tin oxide surface by direct or indirect gravure coating.

The UV-curable organic binder layer is coated with a thickness in the range of about 0.3 mils to 0.8 mils.

A layer of phosphor particles of like electrical polarity charge is electrostatically deposited onto the surface of the UV-curable organic binder layer and then discharged after being applied.

The phosphor particles deposited have a microencapsulated inorganic coating, preferably aluminum oxide. The thickness of the UV-curable organic binder phosphor particle layer is set by passing the partially cured organic binder phosphor particle coated ITO/PET substrate through at least one calender roll. The calender roll is heated to soften the partially cured organic binder to more easily reposition the phosphor particles.

Preferably, coating the UV-curable organic binder includes coating with a clear, UV-curable organic binder, wherein the organic binder is moisture resistant and has a dielectric constant in the range of about greater than 4, a dissipation factor in the range of about less than 0.125, and a dielectric strength in the range of about 1000+/−200 volts per mil.

The front and rear electrodes are continuously joined by passing the front and rear electrodes through a nip laminator, which may be a heated nip laminator.

Preferably, the rear electrode laminate is cut into pairs of parallel strips prior to continuous joining with the front electrode laminate to produce a continuous roll of split-electrode EL lamp laminate material.

A further aspect of the invention relates to an electroluminescent (EL) lamp material having a front electrode laminate comprising an indium tin oxide layer coated on a polyester film, an organic binder layer coated on the indium tin oxide layer and a layer of phosphor particles deposited on the organic binder layer; a rear electrode laminate comprising an aluminum foil polyester film and a barium titanate layer coated on the aluminum foil; and a laminate of the front electrode laminate and the rear electrode laminate with the organic binder layer facing the barium titanate layer to form the EL lamp laminate material. The organic binder is a UV-curable organic binder and the organic binder phosphor particle layer is set to a predetermined thickness prior to laminating the front and rear electrode laminates. The EL lamp material is cut to a desired arbitrary size and shape and further comprises the rear electrode cut to a predetermined depth through the aluminum foil polyester film and partially into the barium titanate layer to produce a split-electrode EL lamp having at least two electrically isolated rear electrode areas. Each of the at least two electrically isolated rear electrode areas have an electrical connector in contact with the aluminum foil for powering the EL lamp.

Preferably, the isolated rear electrode areas are of substantially equal area to emit light of substantially equal brightness and are of unequal area to emit light of unequal brightness. The rear electrode may have multiple pairs of rear electrode areas for special effect lighting.

Alternatively, the EL lamp material is cut to a desired arbitrary size and shape and further comprises the laminate having dual scribe lines along a marginal peripheral region cut to predetermined depths through the laminate, wherein the first of the dual scribe lines is outward of the dual scribe lines and is cut completely through the rear electrode laminate and the phosphor particle organic binder layer terminating at the indium tin oxide layer, and the second of the dual scribe lines is cut to a predetermined depth through the aluminum foil polyester film and partially into the barium titanate layer to produce a parallel-plate EL lamp.

Preferably, the laminate region between the first scribe line and the laminate outer peripheral edge further includes an electrical connector through the laminate and in electrical contact with the indium tin oxide for powering the front electrode defining one plate of the parallel plate EL lamp.

Preferably, the laminate region between the second scribe line and the laminate outer peripheral edge opposite the laminate outer peripheral edge outward of the first scribe line further includes an electrical connector through the laminate and in electrical contact with the aluminum foil for powering the rear electrode defining the other plate of the parallel plate EL lamp.

Preferably, the first scribe line is flooded with a conductive material.

BRIEF DESCRIPTION OF THE DRAWINGS

Other features, benefits and advantages of the present invention will become readily apparent from the following written description of several preferred embodiments taken in conjunction with the drawings wherein.

DETAILED DESCRIPTION OF PREFERRED EMBODIMENTS

Figure 1:
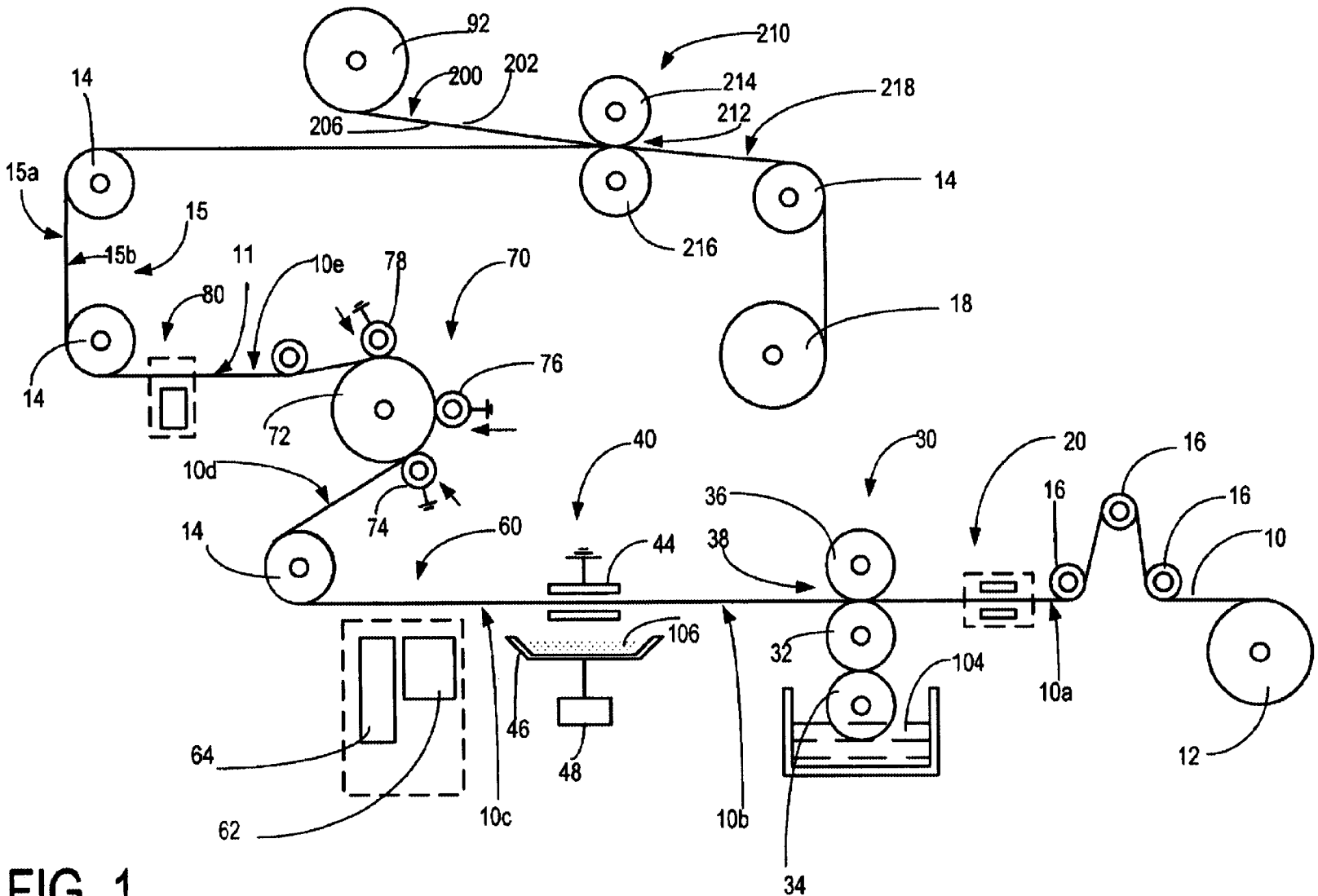
FIG. 1 is a schematic illustration of apparatus for continuous production of the electroluminescent panel of the present invention.

Turning now to the drawings and considering the invention in further detail, a general overview of the large-scale laminated foil-back EL (electroluminescent) panel lamp and associated methods for construction of such EL lamps embodying the present invention is presented to enable the reader to gain a fuller understanding of the exemplary embodiments of the invention. Broadly, the large-scale laminated foil-back EL panel lamp of the present invention has two substrates, referred to for purposes of explanation as a front substrate and rear substrate, which are coated separately and then laminated together as described in further detail herein. The present invention provides additional improvements, features and benefits over the EL lamps and their construction and manufacture as disclosed in U.S. Pat. Nos. 4,534,743, 5,019,748 and 5,045,755 the disclosures of which are hereby incorporated by reference. In the description which follows, like parts and elements have like reference numerals.

Figure 2A:
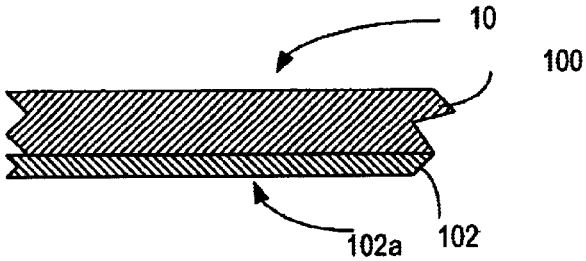
FIGS. 2A–2C are a series of somewhat schematic cross-sections through the width of the front substrate of the EL lamp material as the operative layers are added on one another.

FIG. 1 illustrates schematically apparatus for the continuous processing of the EL basic panel material components into long coils or rolls of indeterminate length. In FIG. 1, the front substrate is provided as a continuous carrier strip 10 of indium/tin oxide coated polyester (ITO/PET), which is conveniently stored on a payoff reel 12. Preferably, the front substrate is polyester (PET) coated with a clear conductive coating such as indium tin oxide (ITO), but other substrates and other conductive coatings now known or future developed that provide the desired characteristics and properties may be used. Preferably, the ITO/PET carrier strip has light transmission greater than 80–85% and sheet resistance in the 100–500 ohms per square inch range. A schematic cross-section of the ITO/PET carrier strip 10 is shown in FIG. 2A, wherein the polyester transparent front substrate is designated 100 and the indium/tin oxide layer coated on the polyester is designated 102.

Uncoiling means well known to those in the machine process art are provided to uncoil the ITO/PET carrier strip 10 from the reel 12 and drive it through a series of guidance strip alignment rolls 14 and tension adjustment controls 16 and ultimately as the front substrate is laminated with the rear substrate to coil the EL laminate material on a take-up reel 18 at the other end of the line. A conventional motor drive (not shown) continuously moves the ITO/PET carrier strip 10 at a substantially continuous speed in the range of about 10 to 80 feet per minute, which speed may be selected in accordance with the presently known component materials and processing techniques and preferably is in the 30 to 60 feet per minute range. It will be understood that the speed may be slower or faster than that stated for other EL component materials now known or future-developed. The width of the ITO/PET carrier strip 10 may be in the range of 6 inches to 55 inches, and the length can be as long as the limits of the material processes allow. For example, the ITO/PET carrier strip 10 currently has an upper limit on length with no splices or ITO coating irregularities of approximately 1800 to 2000 feet, with a more typical length of 1200 feet. It is expected that as ITO coating processes improve, the upper limit length of the ITO/PET carrier strip 10 will also increase. Additionally, the width of the ITO/PET carrier strip 10 may increase for different EL component materials now known or future developed. The EL component materials allow, together with different processing equipment now known or future developed, the manufacture and processing of larger width EL laminate material.

The ITO/PET carrier strip 10 moves continuously from the payoff reel 12 through a commercially available web cleaner generally designated 20 to remove random foreign matter and lint from the ITO/PET strip surface. When the coating cycle is turned on, the ITO/PET carrier strip 10 advances past a gravure coating station, generally designated 30, wherein a UV curable clear organic binder 104 is continuously coated on the ITO face side 10*a* of the ITO/PET carrier strip 10. Preferably, the UV-curable organic binder is a custom-synthesized material with exacting properties. The UV-curable organic binder must be clear, have a relatively high dielectric constant (preferably greater than 4.0 at the lower end for best results), have a relatively low dissipation factor (preferably less than 0.125), have a relatively high dielectric strength (preferably 1000 volts/mil, but typically 800 to 1200 volts/mil), have good adhesion, and must be moisture resistant. Obviously, these parameters may change as new materials and processes are developed.

Figure 2B:
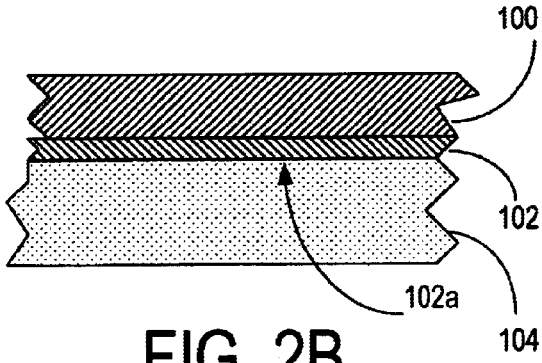

The gravure coating station 30 may utilize any appropriate technique or equipment now known or future developed to apply the UV curable organic binder. In one preferred embodiment, the organic binder is pumped up to a coating head 32 and applied onto the ITO face surface 10*a* when the binder achieves the necessary operating temperature. The binder is a 100% solids UV-curable material whose viscosity is too high to use at room temperature and is therefore heated to the range of 100° F. to 130° F. to lower its viscosity. The coating head 32 is a gravure coating head and can be used in either a direct gravure or offset gravure coating mode. In the direct gravure coating method (not shown in FIG. 1), the organic binder 104 is coated directly onto the ITO face surface 10*a* of the carrier strip 10 to a thickness of 0.3 to 0.8 mils (0.0003 inches to 0.0008 inches). An offset gravure coating method is illustrated in FIG. 1 wherein the organic binder 104 is coated onto an intermediate roll 34 that then transfers the organic binder coating to the gravure coating head 32 which in turn applies the coating onto the ITO face surface 10*a*. The added transfer step of the offset gravure method smoothes out any pattern caused by the individual cells on the gravure coating head surface. Depending on the flow-out characteristics of the binder and the line speed, this added transfer step may or may not be needed. A pressure roller 36 forms a nip 38 with the gravure coating head 32 through which nip the carrier strip 10 passes to receive the organic binder coating layer. A schematic cross-section of the UV clear organic binder coated ITO/PET carrier strip 10 is shown in FIG. 2B, wherein the UV clear organic binder layer is designated 104 and is shown applied to the surface 102*a* of the ITO layer 102.

The organic binder coated ITO/PET carrier strip moves from the gravure coating station 30 to a phosphor depositing station generally designated 40 with the carrier strip substantially parallel with the ground, and with the UV organic binder coating face surface 10*b* facing in a downward direction. The phosphor depositing station 40 is preferably an electrostatic phosphor particulate depositing station which includes a source or pan 46 of dry phosphor particulate powder or particles 106. The phosphor powder is a commercially available EL phosphor with a microencapsulated inorganic coating such as aluminum oxide or aluminum nitride. The pan 46 is connected to a voltage source 48 to make the pan positive relative to the ITO/PET carrier strip which is held at substantially ground potential through contact with grounded guide rollers 14 and contact with a grounding plate 44 located directly above the dry phosphor particulate source 46. The electrostatic phosphor particulate depositing station 40 is designed to place a complete monolayer of phosphor particulate onto the wet (uncured) UV organic binder coating face surface 10*b*. The phosphor particulate powder is propelled in a cloud towards the UV binder coated ITO/PET strip in the presence of a high voltage electric field developed between the pan 46 and the ITO/PET carrier strip. The result of this action is to impart each phosphor particle with a like charge as it moves through this electric field. The charged phosphor particles will tend to avoid stacking on top of each other due to the repulsion of like charges and find exposed or uncovered areas on the UV binder coated ITO/PET surface. The charge on the deposited phosphor particles then bleeds through the UV organic binder to the ITO/PET carrier strip, which is at substantially ground potential due to the strip's contact with the rollers 14 and the grounding plate 44.

Figure 2C:
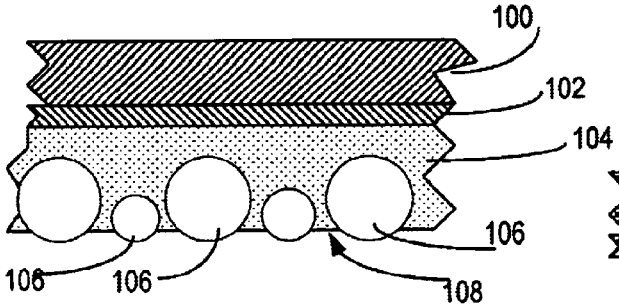

The ITO/PET carrier strip with the phosphor coated wet UV organic binder face surface shown generally as 10*c* leaves the phosphor depositing station 40 and moves through a UV curing station shown generally as 60. Upon exiting the electrostatic deposition chamber, there is approximately a monolayer of phosphor particles partially embedded in the UV curable organic binder. A schematic cross-section of a UV curable organic binder coated ITO/PET strip with a layer of phosphor particles 106 is shown in FIG. 2C wherein the partially embedded phosphor particles project unpredictable distances beyond the surface 108 of the UV curable organic binder layer 104. The UV curing station 60 includes a UV source 62 which has adjustable variable power levels for partially curing the organic binder to firm it up to allow the further embedding of the phosphor particles 106. The process of depositing and further embedding the phosphor particles is referred to generally as a phosphorlayorset process that does not tear out or fracture the phosphor particles that are delicate but, rather, sets the phosphor-organic binder layer to a desired thickness. Upon exiting the UV curing station 60, the ITO/PET carrier strip passes through a phosphor-organic layer thickness setting station 70 having at least one calender roll 72 which presses against the projecting phosphor particles 106 and forces them deeper into the organic binder and substantially even in height with the other phosphor particles in the monolayer. The UV curing station 60 also includes a heater 64 that directs controlled heat at the ITO/PET carrier strip to soften the phosphor-organic binder layer in preparation for its further processing in the layer thickness setting station 70. During processing at the station 70, the partially cured phosphor-organic binder face 10*d* surface of the ITO/PET carrier strip is in contact with the outer peripheral surface of the calender roll 72 which preferably is a thermostatically heat controlled, ceramic finished drum to maintain the phosphor-organic binder layer at a desired temperature. The PET side 10*e* of the ITO/PET carrier strip opposite the partially UV cured phosphor-organic binder layer face 10*d* surface passes through three highly polished rollers 74, 76, 78 spaced along the outer peripheral surface of the drum 72 and which are set at successive heights. The first roller 74 is set to obtain the largest thickness, the second roller 76 is set to obtain a smaller thickness than the first roller 74 but not as thin as the thickness obtained by the setting of roller 78. The result is the phosphor-organic binder layer is set at the proper desired thickness while avoiding harm to the phosphor particles. Quite naturally, in the final assembly of EL lamps that achieve the required quality of EL lamps, maintaining the proper height of the phosphor layer is critical. Upon exiting the layer thickness setting station 70, the ITO/PET carrier strip with the phosphor-organic binder layer shown generally as 11 passes through a second UV curing station 80 to fully cure the phosphor-organic binder layer. The fully cured phosphor coated ITO/PET carrier strip designated generally 15 is generally referred to as the front substrate wherein the UV cured organic binder phosphor side is designated 15*a* and the PET side is designated 15*b* and can be coiled and stored for future use or can continue on as illustrated in FIG. 1 for lamination with a rear substrate to form the basic EL lamp material as described below.

In both the application of the UV curable clear organic binder layer 104 and the electrostatic deposition of the phosphor particles 106 on the ITO/PET carrier strip, the organic binder and phosphor particles are coated continuously and uniformly across the surface of the entire width and length of the ITO/PET carrier strip without surface patterning of the deposits, that is, the deposited surface is smooth.

Figure 3A:
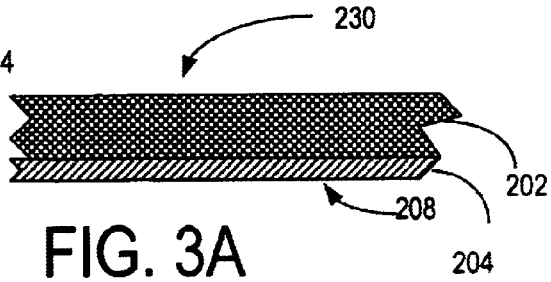
FIGS. 3A and 3B are a series of somewhat schematic cross-sections through the width of the rear substrate of the EL lamp material as the operative layers are added on one another.
Figure 3B:
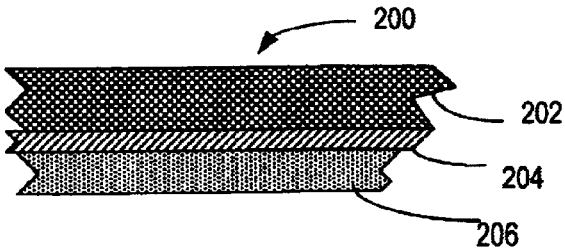

The rear substrate is a polymer film barium titanate coated aluminum foil laminate designated generally as 200 in FIG. 1 and is conveniently stored on a payoff reel 92. Preferably, the aluminum foil is type 1145-0 wherein "1145" identifies the foil as 99.45% aluminum and "0" identifies the foil as being "dead soft." Preferably, the aluminum foil has a thickness in the range of 0.001 inches. Preferably, the polymer film is commercial grade polyester (PET) and has a thickness in the range of 0.002 inches. A schematic cross-section of the aluminum foil/PET laminate 230 is shown in FIG. 3A wherein the aluminum foil is designated 204 and the polyester film is designated 202. The active element is the aluminum foil 204, which forms the EL lamp's rear electrode as explained below. The polyester film 202 is laminated to the aluminum foil 204 for two reasons. First, the laminate allows the processing of the aluminum foil 204 more easily because the polyester film 202 prevents the aluminum foil from tearing and creasing, which the aluminum foil is likely to do during the coating and other operations. Second, the polyester film 202 serves as an insulator for the rear electrode of an operating EL lamp to prevent accidental electrical shock when the EL lamp is powered. The laminate 230 also provides an excellent moisture barrier for the lamp with a one-mil thickness of aluminum foil being considered to be pinhole-free and essentially hermetic. FIG. 3B shows a schematic cross-section of a barium titanate coated aluminum foil/PET laminate wherein the barium titanate layer designated 206 is coated on the aluminum foil face surface of the laminate 230.

Figure 5:
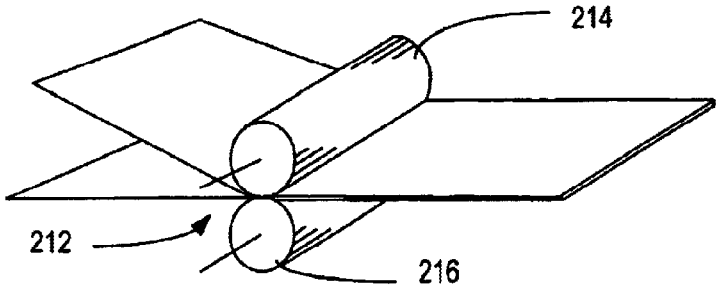
FIG. 5 is a schematic illustration of a heat and pressure nip roller assembly for laminating the front and rear substrates to form the electroluminescent panel base material.
Figure 4:
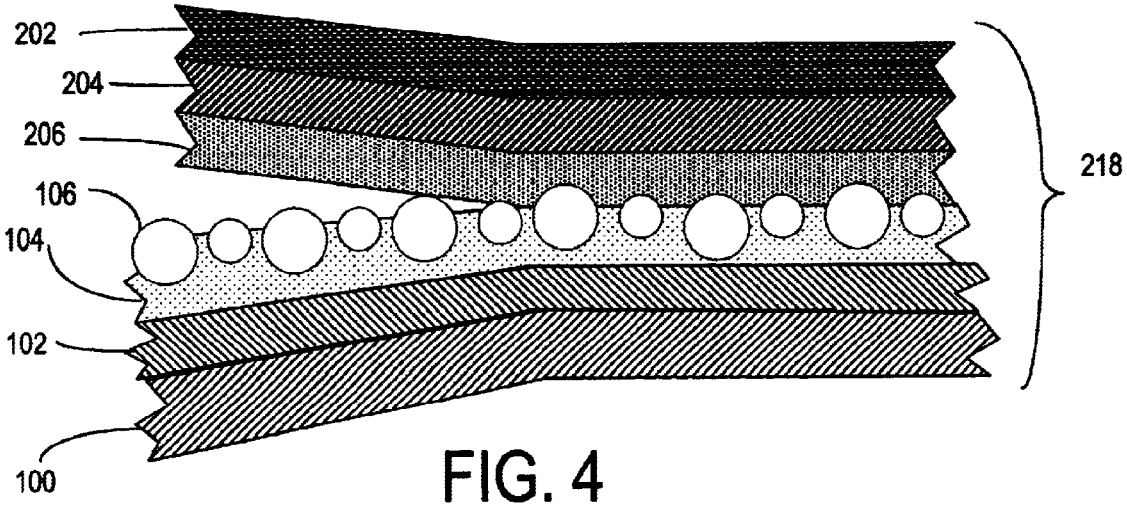
FIG. 4 is a somewhat schematic cross-section through the widths of the front and rear substrates of the EL lamp material as it might appear entering and leaving the laminating nip.

The UV cured ITO/PET phosphor particle embedded laminate defining the front substrate 15 and the barium titanate coated aluminum foil/PET laminate 200 defining the rear substrate are laminated together with the barium titanate coating layer 206 facing the organic binder phosphor particle coating layer 15*a* as shown in FIG. 4. The front and rear substrates are continuously laminated together in a heated-nip laminating station, generally designated 210 in FIG. 1, under heat and pressure using unwind and rewind equipment (not illustrated). Preferably, the nip temperature is in the range of approximately 250 to 350 degrees Fahrenheit. Preferably, the nip pressure is in the range of approximately 50 to 100 pounds per lineal inch. The barium titanate layer is designed to flow around the exposed top of each phosphor particle and completely embed it during the laminating step. As a result, the total thickness of the finished EL lamp laminate is thinner than the measured thickness of the sum of each of the front and rear coated substrates. FIG. 5 is a schematic illustration of a representative embodiment of the heated-nip laminating station 210 wherein rollers 214 and 216 are positioned and arranged for relative movement to one another and form a nip 212 into which the front substrate and rear substrate are fed. The rollers 214 and 216 are arranged to provide pressure to the front and rear substrates as they continuously pass through the rollers to join the front and rear substrates to form the EL lamp laminate material. Preferably, one or both of the rollers 214, 216 are heated.

Figure 6:
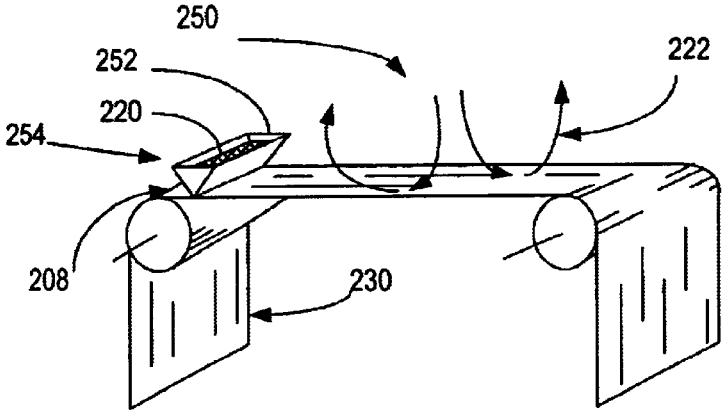
FIG. 6 is a schematic illustration of apparatus for coating a layer of barium titanate on the aluminum foil surface of the rear substrate.

FIG. 6 is a schematic illustration of an apparatus generally designated 250 for applying a coating of barium titanate/organic binder mixture 220 to the aluminum foil face surface 208 of the aluminum foil/PET laminate 230. The barium titanate/organic binder mixture 220 is contained in a hopper 252 of a knife-over-roll coat or reverse-roll coat depositing station 254. The barium titanate/organic binder mixture 220 is applied to the surface face 208 of the aluminum foil/PET laminate 230 as the laminate moves through the depositing station 254. The barium titanate/organic binder mixture 220 is coated as a solvent slurry with a viscosity of approximately 800 centipoises at 75° F. and cured in a drying oven (not shown in FIG. 6). Solvent vapors 222 are exhausted during the drying process. The organic binder has a number of specific properties and can be, acrylic, polyvinylidine fluoride (PVDF) or other fluorinated or thermoplastic polymers. The characteristics required for the organic binder are a high dielectric constant, high dielectric strength, good moisture barrier properties, good adhesion and thermoplastic. The organic binder and barium titanate are coated continuously and uniformly across the entire width and length of the web of the laminate 230. As in the case of the front substrate, there is no patterning of the deposits on the foil surface face.

The barium titanate organic binder layer has several functions among other functions in the finished EL lamp primarily however: 1) acting as a voltage impedance layer to prevent voltage breakdown between the front and rear electrodes; 2) acting as a heat-seal adhesive layer for laminating the front and rear substrates together; 3) acting as a diffuse reflector behind the light emitting phosphor layer, and 4) acting as a moisture barrier layer to reduce or minimize moisture transmission to the phosphor particles.

It will be apparent that one advantage of the method of the present invention is there are no registration issues during the lamination process, other than alignment of the two substrates to maximize yield. The front and rear substrates thus laminated create a continuous coil of base EL lamp material 218 which is uniform and continuous across the entire width and length of the web. As illustrated in FIG. 1, the continuous coil of EL lamp material 218 is wound on the take-up reel 18. Again, the upper limit on length with no splices or ITO coating irregularities is approximately 1800 to 2000 feet. As processing methods improve, the length of the base EL lamp material will increase.

Although the apparatus of FIG. 1 contemplates the rear substrate is preformed as a barium titanate coated aluminum foil/PET substrate, the aluminum foil/PET substrate can be coated as part of the process using apparatus similar to that shown in FIG. 6 located prior to the laminating station 210.

Figure 7:
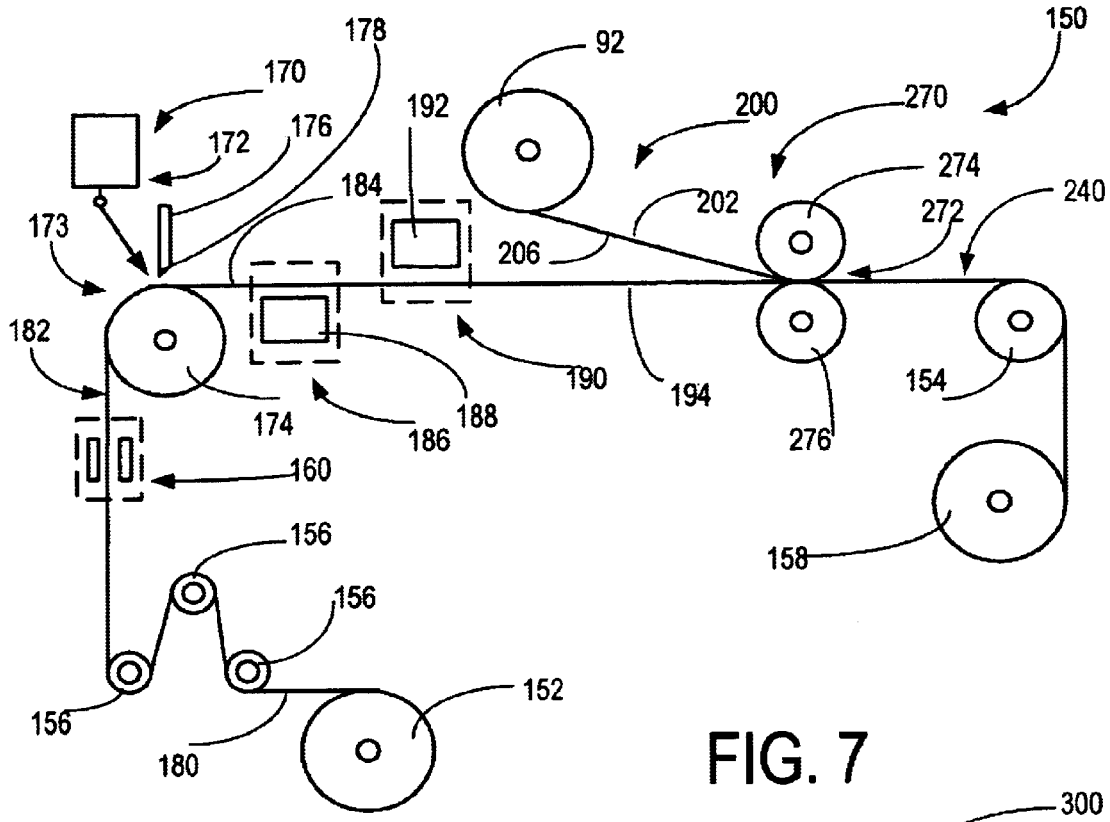
FIG. 7 is a schematic illustration of an alternate apparatus for the continuous production of the electroluminescent panel of the present invention.

Turning now to FIG. 7, alternate apparatus particularly suitable for the production of smaller volumes of electroluminescent panels is schematically illustrated therein and generally designated 150. In FIG. 7, the front substrate is provided as a continuous carrier strip 180 of indium/tin oxide coated polyester (ITO/PET) substantially identical to the ITO/PET carrier strip described in conjunction with FIG. 1. The ITO/PET carrier strip 180 is conveniently stored on a payoff reel 152. Uncoiling means are provided to uncoil the ITO/PET carrier strip 180 from the reel 152 and drive it through a series of guidance strip alignment rollers 154 and tension adjustment controls 156 and ultimately as the front substrate is laminated with the rear substrate to coil the EL laminate material 240 on a take-up reel 158 at the other end of the line. A conventional motor drive (not shown) continuously moves the ITO/PET carrier strip 180 from the payoff reel 152 through a commercially available web cleaner, generally designated 160, to remove random foreign matter and lint from the ITO/PET strip surface. The ITO/PET carrier strip 180 advances from the web cleaner 160 to a knife-over-roller deposition station, generally designated 170. A slurry of phosphor particles in an uncured UV organic binder is contained in a slurry reservoir 172, which also includes a mixer (not shown) to maintain as uniformly as possible a distribution of the phosphor particulate in the slurry. The slurry of phosphor particulate and uncured UV binder is delivered to the knife-over-roller deposition station 170, which includes a roller 174 and a knife 176 having an edge 178 positioned to provide the desired layer thickness of the phosphor particulate and UV binder mixture on the ITO face surface 182. The knife edge 178 "wipes" the excess slurry delivered to the ITO surface 182 by the slurry applicator head 173. The phosphor particulate and UV-binder-coated ITO surface 184 passes through one or more UV curing stations 186 and 190, each disposed on opposite sides of the carrier strip. The UV curing stations 186, 190 each include a UV source 188, 192, respectively, to cure the phosphor particulate UV binder layer. The cured phosphor UV binder layer ITO/PET carrier strip 194 moves to a heated nip lamination station generally designated 270. The rear substrate generally designated 200 comprises a laminate made of an aluminum foil generally designated 202, a polyester film 204 and a barium titanate layer 206 as described above in connection with FIG. 1. The rear substrate is conveniently stored on a payoff reel 92 and is fed to and through a nip 272 formed between rollers 274, 276. Preferably, one of the rollers 274, 276 is a heated roller and the front and rear substrates are continuously laminated together under heat and pressure using unwind and rewind equipment (not illustrated) in a similar manner as described above in connection with FIG. 1. The front and rear substrates are laminated with the barium titanate layer 206 face-to-face with the phosphor particulate UV binder layer 184. The resulting EL laminate lamp material 240 is coiled and wound on the take-up reel 158.

Figure 8:
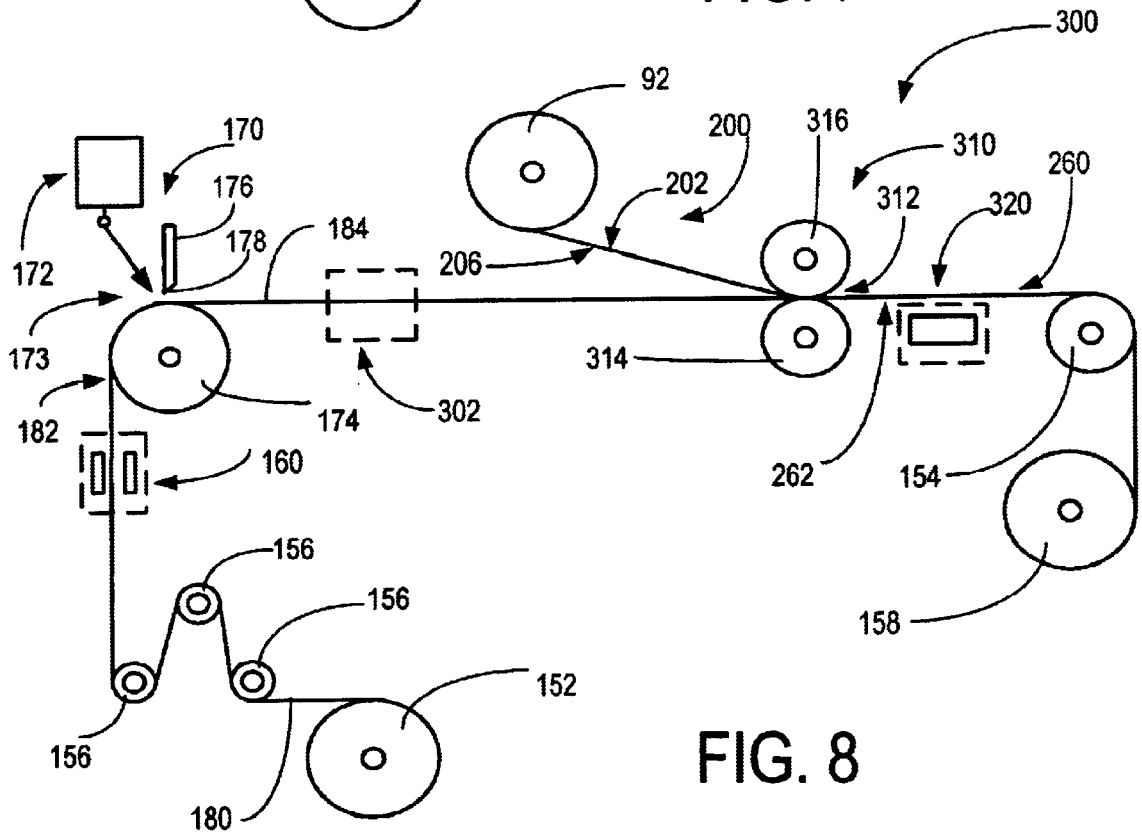
FIG. 8 is a schematic illustration of a further alternate apparatus for the continuous production of the electroluminescent panel of the present invention.

Turning now to FIG. 8, a further alternate apparatus for the continuous production of electroluminescent panels is schematically illustrated therein and generally designated 300. The apparatus 300 is similar to the apparatus 150 of FIG. 7 and like parts have like reference numerals. The front substrate has a slurry of UV organic binder and phosphor particulate applied to the ITO side 182 of the ITO/PET carrier strip 180 and is wet as it moves past the knife-over-roll deposition station 170. If a solvent is used to lower the viscosity of the slurry, then the solvent is dried by passing the coating through an in-line oven shown in the dashed line box 302. The wet slurry coated ITO/PET strip is immediately laminated to the rear substrate 200 under pressure only in a pressure laminating station generally designated 310. The barium coated aluminum foil PET strip 200 is made as described above and enters the nip 312 of the pressure laminating station 310 with the barium coated side 206 of the rear substrate facing the wet UV organic binder phosphor particulate slurry side 184 of the front substrate. The nip 312 is formed by rollers 314, 316 adjustably spaced relative to one another to provide the desired laminating pressure and EL lamp laminate thickness. The thus laminated front and rear substrates now pass through a UV curing station generally designated 320 which is positioned on the front or ITO face side 262 of the laminate to cure the UV organic binder and produce the EL lamp laminate material 260. The base EL lamp material 260 is coiled on the take up reel 158 and may be stored for future use as described above.

Figure 9:
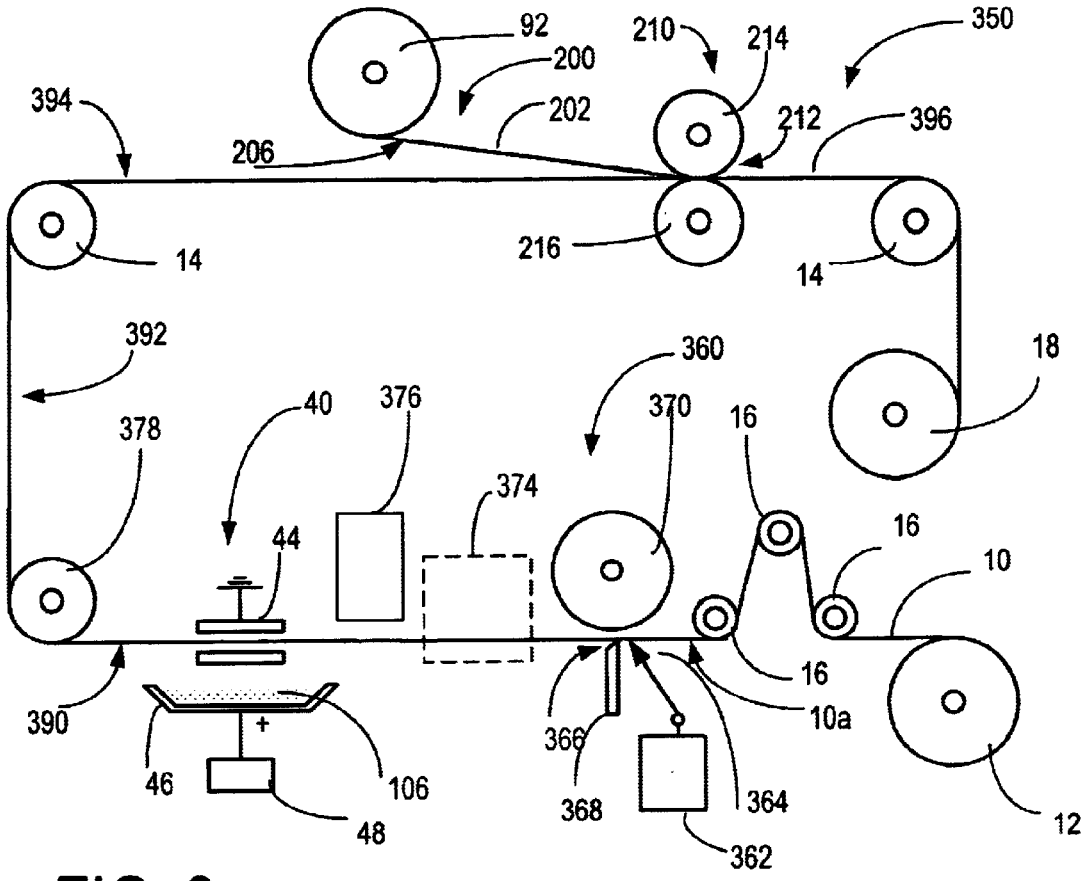
FIG. 9 is a schematic illustration of a further alternate apparatus for the continuous production of the electroluminescent panel of the present invention.

Turning now to FIG. 9, an alternate apparatus for the continuous production of electroluminescent panel is schematically illustrated therein and generally designated 350. The apparatus 350 is similar to the apparatus illustrated in FIG. 1 in that phosphor particulate electrostatically deposited on the front substrate is then laminated with the rear substrate as discussed in connection with FIG. 1, and accordingly like parts have like reference numerals. The front substrate is provided as a continuous carrier strip 10 of ITO/PET from a payoff reel 12. The ITO/PET carrier strip 10 uncoils from the reel 12 through a series of tension adjustment controls 16. The carrier strip 10 then passes through a web cleaner (not shown) to remove any debris or particulate from the surface prior to entering a knife-over-roll coating station, generally designated 360, wherein a thermoplastic clear organic binder is pumped from a storage reservoir 362 to an applicator head 364, which applies the binder to the ITO surface side 10*a* of the carrier strip 10. The height of the edge 366 of the knife 368 is adjusted to provide the desired layer thickness of the binder on the ITO face as the carrier strip moves between the knife edge 366 and the roller 370. If a solvent is used to lower the viscosity of the binder, the solvent is dried by passing the coated carrier strip through an in-line oven illustrated by the dashed-line box 374. The thermoplastic clear organic binder coated carrier strip is then preheated to a desired predetermined temperature by the heater 376 prior to the carrier strip entering the electrostatic phosphor particulate depositing station 40. The heater 376 softens the thermoplastic clear organic binder upon which a layer of phosphor particulate 106 is electrostatically deposited as the carrier strip moves through the electrostatic deposition station 40, which operates as discussed above in connection with FIG. 1. Upon exiting the electrostatic deposition station 40, the phosphor particulate coated thermoplastic clear organic binder and carrier strip forming the front substrate 390, passes over a conventional chill roll 378 to firm the phosphor organic binder layer. The firmed front substrate 392 moves to a heated nip lamination station, generally designated 210. The barium titanate coated aluminum foil/PET rear substrate 200 is fed from a payoff reel 92 and enters the nip 212 formed by the rollers 214, 216 with the phosphor coated thermoplastic clear organic binder side 394 of the front substrate 392 facing the barium titanate side 206 of the rear substrate 200 as the front and rear substrates enter the nip 212. The front and rear substrates are continuously laminated together in the heated nip laminating station 210 as described above in connection with FIG. 1 to form the EL panel lamp material 396, which is coiled on the take-up reel 18 and may be stored for future use as described above.

Figure 10:
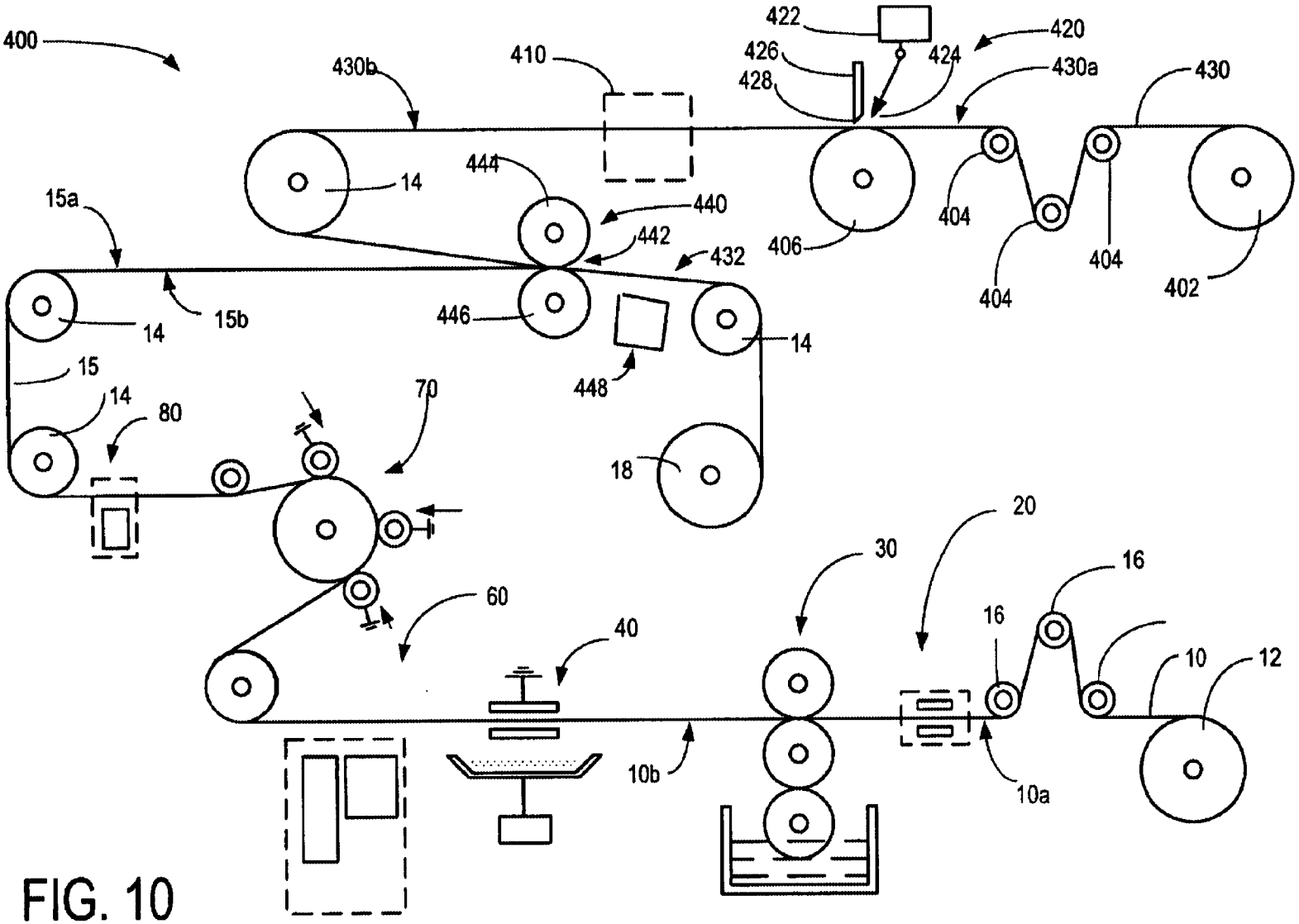
FIG. 10 is a schematic illustration of a yet further alternate apparatus for the continuous production of the electroluminescent panel of the present invention.

Turning now to FIG. 10, an alternate apparatus for the continuous production of electroluminescent panel is schematically illustrated therein and generally designated 400. The apparatus 400 is similar to the apparatus illustrated in FIG. 1 and the front substrate 15 is constructed substantially identically to that described in FIG. 1, and therefore like parts have like reference numerals and operate in substantially identical fashion to that described above in connection with FIG. 1. The basic difference between the apparatus 400 of FIG. 10 and that of FIG. 1 is that the aluminum foil/PET rear substrate is processed in a different manner. In FIG. 10, the aluminum foil/PET carrier strip 430 is stored on a payoff reel 402 and is uncoiled using conventional uncoiling means (not shown in FIG. 10) to advance the aluminum foil/PET carrier strip 430 through a series of tension adjusting controls 404 to a barium titanate coating station, generally designated 420. The aluminum foil/PET carrier strip 430 is substantially identical in construction to the carrier strip shown in FIG. 3A. The aluminum foil side 430*a* faces upward in the figure and is coated with a mixture of barium titanate and UV curable organic binder, which is stored in a reservoir 422. The barium titanate UV curable organic binder mixture is applied to the surface 430*a* by means of an applicator head 424. The depositing station 420 is a knife-over-roll apparatus and comprises a knife 426 having an edge 428 adjustably positioned at a distance from the surface 430*a* as the foil/PET carrier 430 passes over the peripheral outer circumferential surface of a roller 406 to provide the desired layer thickness of the barium titanate UV curable organic binder mixture on the aluminum foil. Although a knife-over-roll apparatus is illustrated, any suitable method, such as a reverse roll coat, may also be utilized to provide the desired layer thickness of the barium titanate UV curable organic binder mixture. If a solvent of some type is used to lower the viscosity, then the solvent is dried by passing the coating through an in-line oven, generally designated by the dashed-line box 410. The wet barium titanate organic binder coated rear substrate 430*b* moves in a continuous fashion to a pressure laminating station, generally designated 440, into a nip 442 formed by rollers 444, 446. The rear substrate with the barium titanate UV curable organic binder layer 430*b* is laminated with the front substrate 15 with the wet barium titanate UV curable organic binder layer facing the phosphor organic binder side 15*a* of the front substrate 15 as the rear and front substrates pass through the pressure nip 442. As the front and rear substrates move through the nip 442, the barium titanate UV curable organic binder mixture surrounds any phosphor particulate extending beyond the surface of the organic binder of the front substrate. The thus laminated rear and front substrates pass a UV curing station, generally designated 448, wherein the barium titanate UV curable organic binder is fully cured. The fully cured EL lamp laminate material 432 is then wound on the take-up reel 18 as previously described.

The completed coil of base EL lamp material made in accordance with any of the above-discussed methods is now ready to be fabricated into specific customer applications. A benefit of the process of the EL electroluminescent panel lamp material of the present invention is that the EL panel lamp material can be fabricated prior to knowing the specific customer size or shape requirements of the completed EL lamps. The roll of EL panel lamp material contains large surface areas from which customers on their own and in their own design can use devices as simple as scissors or by complex high production tooling devices to remove individual lamps from the basic EL panel lamp material. Once a customer's requirements are known, the basic or "raw" EL lamp material coil can be cut up using standard slitting and sheeting operations to match the customer's required dimensions. The pieces of the "raw" EL lamp material so cut will then have the rear foil electrode parted in a process called "scribing," after which an electrical terminal is applied to each side of the scribed polyester to complete the construction of an active split-electrode EL lamp. Alternate construction and terminal connection methods embodying the present invention are described below.

Figure 11:
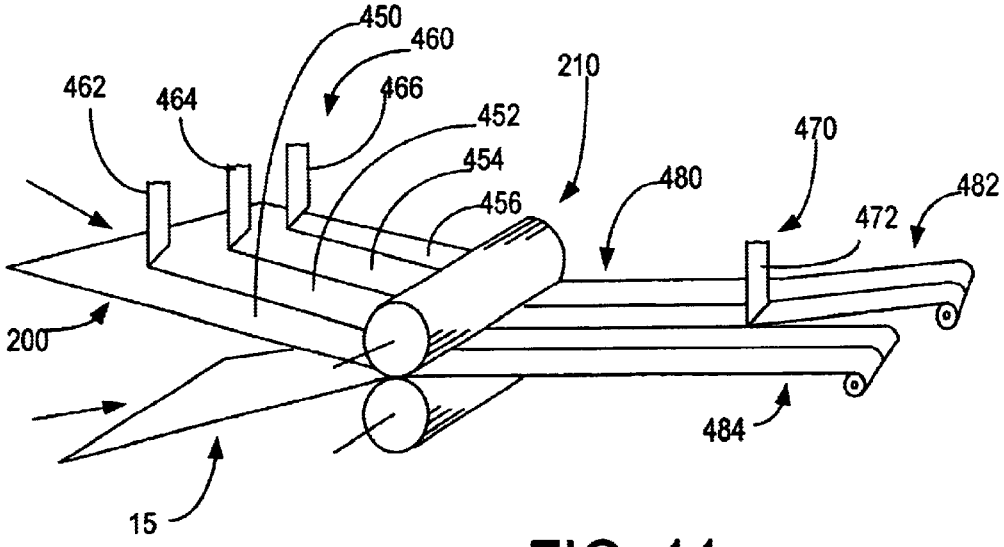
FIG. 11 is a schematic illustration of an alternate lamination process to produce a coil of split-electrode construction EL lamp material without scribing.

In an alternate embodiment of the invention as illustrated schematically in FIG. 11, one or more coils of split-electrode EL lamp material can be fabricated as part of the EL laminate lamp material construction. FIG. 11 illustrates the barium titanate organic binder coated FOIL/PET substrate 200 passing cutting means, generally designated 460, comprising one or more knife edges 462, 464, 466 positioned parallel to one another and substantially perpendicular to the substrate 200. The cutting means 460 is located immediately prior to the laminating station 210 and cuts or slits the rear substrate into strips 450, 452, 454, 456 of pre-defined widths. These strips are then laminated in pairs or multiple pairs, under heat and pressure in the nip-heated laminating station 210 as discussed in connection with FIG. 1. The lamination process is carried out with extreme precision to maintain a separation of 0.006 inches to 0.012 inches between the strips. Once the laminating process is completed, the laminated pairs are slit into narrower strips by cutting means generally designated 470 made up of one or more knife edges 472 positioned substantially perpendicular to the EL laminate lamp material 480 between pairs 450, 452 and 454, 456 of strips. The resulting slit laminate 482, 484 are each a coil of split electrode EL lamp construction which does not need scribing as described in connection with "raw" EL lamp material further produced as uncut laminate. Here the split-electrode EL lamp is prescribed as a result of the lamination procedure thus saving a processing step and eliminating sacrificial yield losses which are generated as a result of the scribing process. The slit laminates 482, 484 are coiled on take-up reels for future use.

Figure 13:
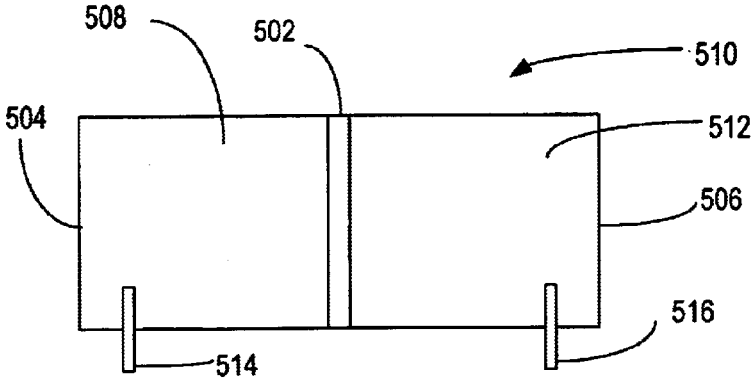
FIG. 13 is a plan view of the back of a finished split-electrode EL lamp made in accordance with the present invention showing the scribe line and electrical connectors.
Figure 12:
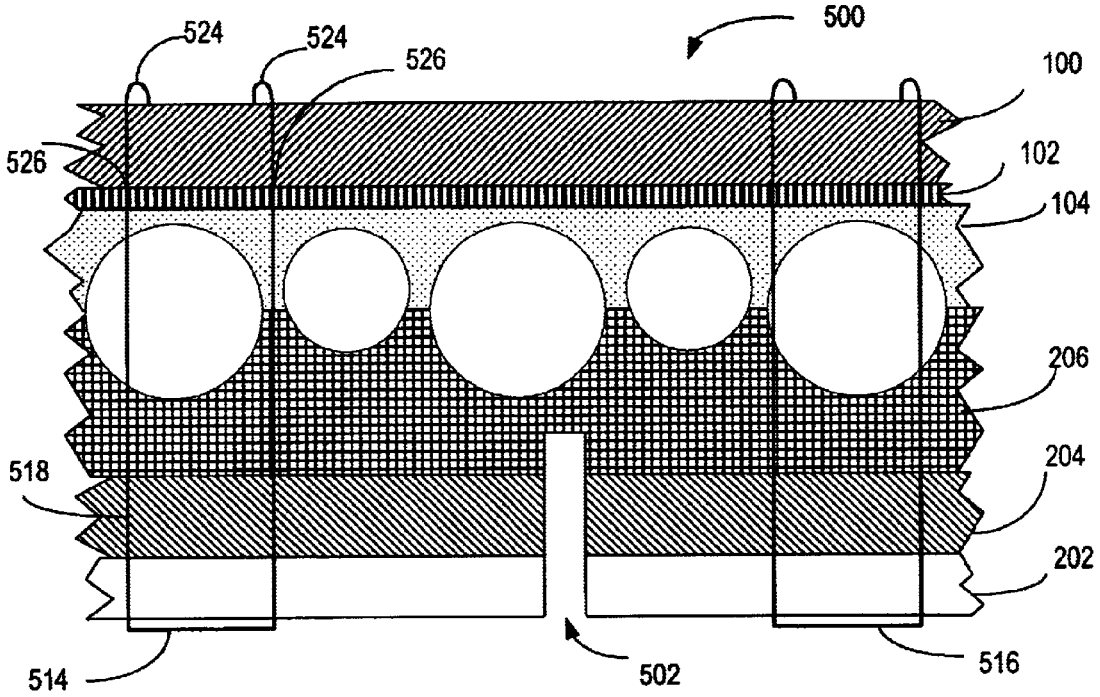
FIG. 12 is a cross-section view of a finished split-electrode EL lamp cut from a continuous roll of EL lamp material made in accordance with the present invention showing the scribe line and electrical connectors.
Figure 17:
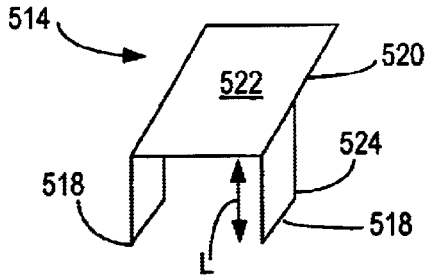
FIG. 17 is a schematic perspective view of an electrical connector of the type that may be used in the present invention.
Figure 18:
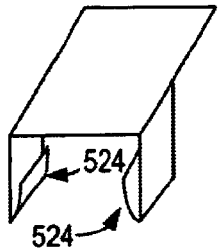
FIG. 18 shows the electrical connector of FIG. 17 with the connector leg ends bent to provide gripping attachment to the EL lamp.

Turning now to FIG. 12, a cross-sectional view of a finished split electrode EL lamp cut from a continuous roll of EL lamp material made in accordance with the present invention is shown schematically therein and generally designated 500. FIG. 13 is a plan view of the back of a finished EL lamp and is generally designated 510. In the embodiments illustrated in FIGS. 12 and 13, the scribe line, generally designated 502, splits or cuts through the rear substrate into the EL lamp material a depth that goes through the polyester 202, aluminum foil 204 and partially into the barium titanate layer 206. As illustrated in FIG. 13, the scribe line 502 is substantially down the middle, that is, approximately the center, between the edges 504, 506 to define two substantially equal areas 508, 512. The substantially equal areas 508, 512 cause the EL lamp to produce substantially equal illumination when power is applied to the EL lamp by means of connectors 514, 516. The connectors 514, 516 are illustrated in FIGS. 17 and 18. The connector 514 has at least one leg 518 extending from and integral to and in electrical and mechanical contact with a tab portion 520, which has a surface 522 to which electrical connection or electrical contact is made. In the illustrated embodiment, the connector 514 has two legs 518 extending substantially perpendicular from the plane of the tab 520. The length L of the leg 518 is of sufficient length to extend through the thickness of the EL lamp material laminate such that the end portion 524 of the leg 518 can be bent over and crimped to hold the connector 514 in contact with the aluminum foil 204 and the EL lamp material laminate, as illustrated in FIG. 12. When the connector 514 is first inserted and crimped to hold the EL lamp material laminate, an electrical short circuit is created between the ITO layer 102 and the aluminum foil 204. As illustrated in FIG. 12, the leg 518 of the connector 514 passes through the ITO layer 102 and creates an electrical short circuit between the connector 514 and the ITO in the region around the leg portion 526. When electrical power is first supplied to the lamp, the ITO in the region around the leg portions 526 will vaporize to remove the electrical short circuit due to the electrical current that will attempt to flow through the ITO conductive path. Once the electrical short circuit is removed, the EL lamp will transmit light from the front electrode.

Figure 14:
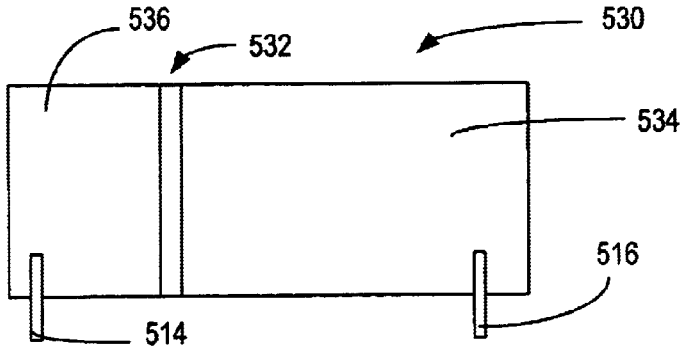
FIG. 14 is a plan view of the back of a finished split-electrode EL lamp made in accordance with the present invention showing the scribe line off-center and electrical connectors to produce special effects.

FIG. 14 is a plan view of the back of a finished EL lamp made in accordance with the present invention and is generally designated 530, wherein the scribe line, shown generally as 532, splits the rear electrode of the EL lamp to create unequal surface areas 534, 536. Connectors 514, 516 pass through the EL lamp material laminate and function as described in connection with FIGS. 12 and 13. Since the rear electrode surface areas 534, 536 are unequal in surface area, the electrical current will divide substantially proportionate to the rear electrode surface area in a similar manner as a parallel resistor electric circuit. The voltage applied to the EL lamp via the connectors 514, 516 will divide substantially proportionate to the ratio of the two rear electrode surface areas in a similar manner as two capacitors in series in an electrical circuit. In an electrical circuit, a voltage divider is formed by two capacitors in series. If the capacitors are equal in value, the voltage will divide evenly across each of the capacitors. If the capacitors are not equal in value, the voltages will divide unequally with the smaller capacitor receiving the larger proportionate value. Likewise, the smaller surface electrode area in the EL lamp will receive the higher proportionate value and will be brighter than the larger surface electrode area. It can be seen that locating the scribe line 532 at different locations along the rear electrode permits the production of special effect lighting; that is, lighter and darker areas relative to one another.

Figure 15:
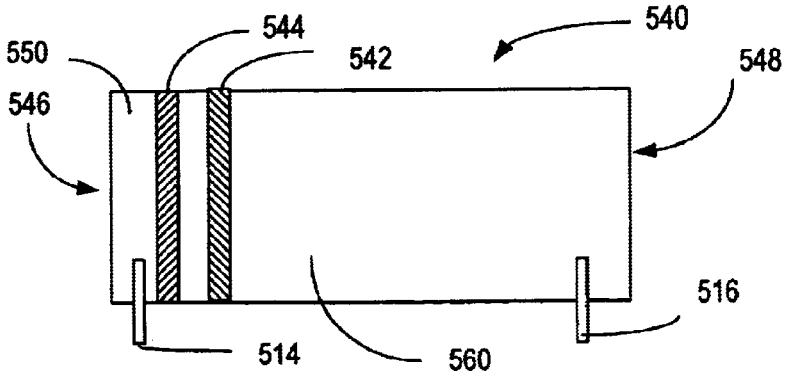
FIG. 15 is a plan view of the back of a finished parallel-plate EL lamp made in accordance with the present invention showing dual off-center scribe lines and electrical connectors.
Figure 16:
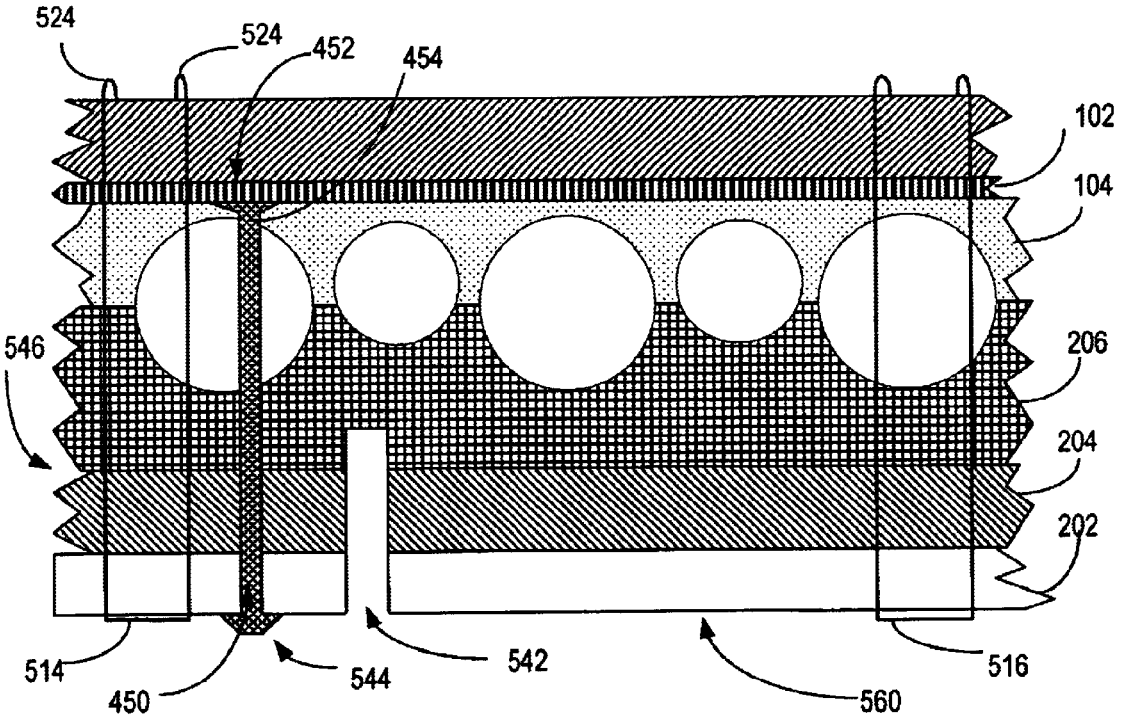
FIG. 16 is a cross-section view of a finished parallel-plate EL lamp cut from a continuous roll of EL lamp material made in accordance with the present invention showing off-centered scribe lines and silver ink connection through one scribe line to the front electrode.

Turning now to FIGS. 15 and 16, a parallel plate EL lamp is constructed from the EL lamp material made in accordance with the present invention, wherein dual scribe lines located along one marginal edge create a large surface area for illumination. A plan view of the parallel plate EL lamp is illustrated in FIG. 15 and is generally designated 540. The parallel plate EL lamp 540 is shown with two scribe lines 542, 544 along one marginal edge region generally designated 546. The scribe line 542, as illustrated in FIG. 16, is of sufficient depth to pass through the polyester layer 202, aluminum layer 204 and partially into the barium titanate layer 206. The scribe line 544 cuts through the polyester layer 202, aluminum layer 204, barium titanate layer 206, through the phosphor particles 106 in the phosphor monolayer, through the UV organic binder layer 104, to the ITO layer 102. A silver ink 450 floods the void left by the scribe line 544 to completely fill the void so that contact is made between the silver ink 450 and the ITO layer 102 in the region 452 at the end 454 of the scribe line 544 and the aluminum layer 550. When power is supplied to the connectors 514, 516, the rear electrode area 560 will have one polarity voltage applied and the ITO/phosphor UV binder electrode will have a second voltage polarity applied to it by means of the electrical connection made by the silver ink 450 extending through the EL laminate to the ITO layer 102. The purpose and function of the connector 514 at the marginal edge area 546 is to provide a means of electrical connection to the EL lamp and to provide a mechanical and electrical mounting area for an external connection. The crimping of the legs 524 maintains the contact between the connector 514 and the laminate. The voltage is applied to the ITO layer 102 by means of the silver ink 450. Since the scribe lines 542, 544 can be located very close to one edge 546, the remaining surface area between the scribe line 542 and the edge 548 transmits light.

Figure 19:
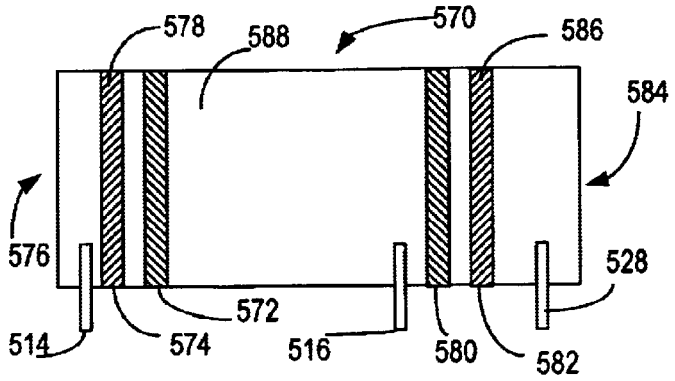
FIG. 19 is a plan view of an alternate embodiment of a finished parallel-plate EL lamp showing multiple dual-scribe lines.

Referring now to FIG. 19, a plan view of an alternate embodiment of a finished parallel plate EL lamp having multiple dual scribe lines is illustrated therein and generally designated 570. The parallel plate lamp of FIG. 19 is somewhat similar to the parallel plate lamp illustrated in FIG. 15 and includes connectors 514, 516, 528. In the illustrated embodiment of FIG. 19, scribe lines 572, 574 are along one marginal end region 576, wherein the scribe line 572 cuts through the polyester, and aluminum layers into the barium titanate layer as described above in connection with FIG. 16. The scribe line 574 cuts through the layers of the laminate to the surface of the ITO layer 102 as described above in connection with FIG. 16. The scribe line 574 is flooded with a conductive material, such as silver ink 578, to provide connection to the ITO layer. Scribe lines 580, 582 are located along the marginal edge 584 opposite the marginal edge 576. The scribe line 580 is likewise cut to a depth to penetrate the barium titanate layer and separate the aluminum foil and polyester layer as described above in connection with the scribe line 542 of FIG. 16. Likewise, the scribe line 582 is cut through the laminate from the rear electrode surface to the ITO surface layer 102 and is flooded with a conductive material, such as silver ink 586, to provide an electrical connection from the connector 528 to the ITO layer 102. The connector 516 provides an electrical connection to the aluminum foil rear electrode area 588. The alternate embodiment illustrated in FIG. 19 allows the finished parallel plate EL lamp to be substantially larger with minimal variation in the light brightness across the front electrode surface.

Figure 20:
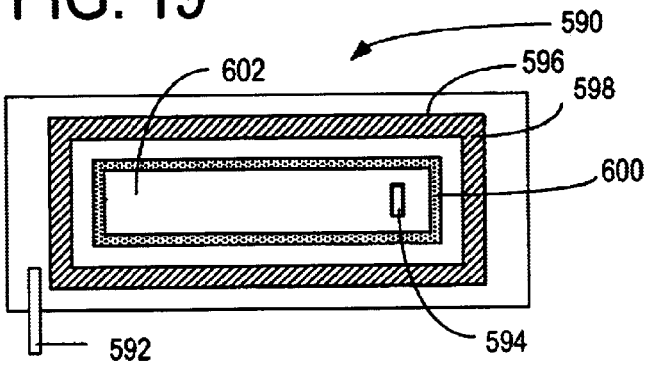
FIG. 20 is a plan view of a further alternate embodiment of a finished parallel-plate lamp having dual-scribe lines located along the back surface marginal peripheral edge region.

FIG. 20 is a further alternate embodiment of a finished parallel plate EL lamp having dual scribe lines located along the marginal peripheral edge regions on all sides of the lamp to increase the maximum lamp size that can be made using a parallel plate construction with a minimal variation in brightness across the lamp. The finished parallel plate EL lamp is designated generally 590 and includes electrical connectors 592, 594. A scribe line 596 is cut on all four sides through the layers to a depth to the ITO layer. The void created by the scribe line 596 is filled with a conductive material, such as a silver ink 598, and functions as described above in connection with the description of FIG. 16. A second scribe line 600 is substantially parallel to the scribe line 596 and splits the rear electrode as described above in connection with the scribe line 542 of FIG. 16. The electrical connectors 592, 594 function similarly and in a substantially identical manner as the connectors 514, 516 described and illustrated above. In the illustrated embodiment of FIG. 20, power is supplied to the connectors 592, 594 to light the area corresponding to the rear electrode area shown as 602. As in the parallel plate embodiment illustrated in FIG. 19, the parallel plate EL lamp embodiment illustrated in FIG. 20 maximizes the lamp size that can be made with a parallel plate construction with a minimal variation in brightness across the lamp.

Figure 21:
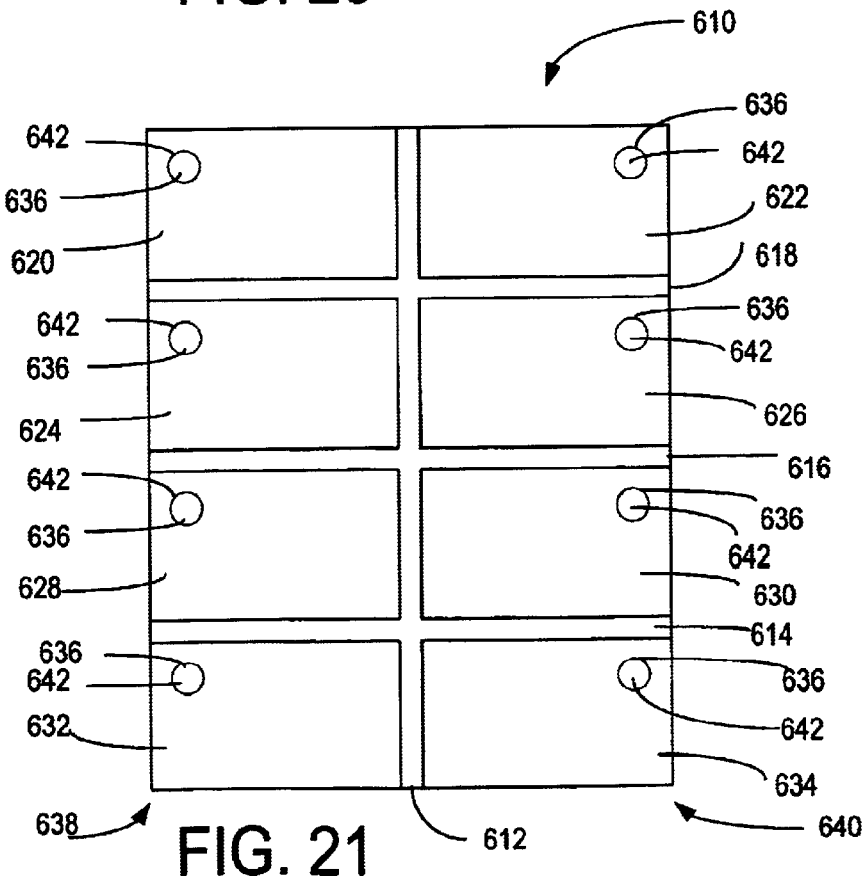
FIG. 21 is a plan view of an array of EL lamp rear electrodes made from multiple scribe lines to produce special effect lighting.

Turning now to FIG. 21, an array of rear electrodes made from multiple scribe lines is shown in plan view and generally designated 610. As illustrated in FIG. 21, the rear electrode is scribed with multiple scribe lines 612, 614, 616, 618 to provide an array of rear electrode surface areas 620, 622, 624, 626, 628, 630, 632, 634. Each rear electrode array is provided with an electrical connector 636 located along the marginal edge region, generally designated 638, 640, respectively. An electrical conductor or cable 642 extends from each connector 636 for providing power to the EL lamp. The connector 636 is substantially identical in function and operation as described above in connection with the connector 514. The isolated and individual rear electrode sections 620-634 are isolated from one another and must be activated or powered in pairs or multiple pairs to provide the desired special effect lighting. For example, applying power to the connector 636 of rear electrode section 622 and the connector 636 of the rear electrode section 632 will cause light to be transmitted from the front electrode under the regions corresponding to the areas 622, 632. It can be seen that by powering individual pairs light will be transmitted through the front electrode corresponding to the rear electrode areas being powered. Special lighting effects, such as bar lighting, sequential lighting and random lighting, can be produced by controlling the voltage applied to the various segments in accordance with the desired lighting patterns.

A method and apparatus for the continuous manufacturing of EL lamp material and EL lamps made therefrom has been disclosed above in several preferred embodiments for purposes of explanation rather than limitation. Further materials comprising the various layers of the finished EL lamp material laminate having the desired characteristics may be used without departing from the spirit and scope of the invention as understood by those skilled in the art of EL lamp manufacturing and production.

What is claimed is:

1. Method for continuously manufacturing EL lamp material comprising the steps of:

providing a front electrode laminate comprising the steps of:

providing a continuous coil of indium tin oxide coated polyester (ITO/PET) film;

applying an organic binder to the indium tin oxide (ITO) surface of the ITO/PET film by means of a roller, and depositing a mono-layer of phosphor particulate onto the organic binder defining a front electrode laminate;

providing a rear electrode laminate comprising the steps of:

providing a continuous coil of an aluminum foil polyester film, and applying a layer of barium titanate to the aluminum foil surface of the aluminum foil polyester film defining a rear electrode laminate;

continuously joining said front electrode laminate and said rear electrode laminate with said organic binder phosphor particulate layer facing said barium titanate layer to produce a continuous roll of EL lamp laminate material having an ITO front electrode and an aluminum foil rear electrode.

2. The method as defined in claim 1, wherein the step of providing a front electrode laminate includes the steps of:

applying an organic binder comprising a UV-curable organic binder to the ITO surface of the ITO/PET film;

electrostatically depositing a mono-layer of phosphor particulate on the UV-curable organic binder surface wherein the phosphor particulate is partially embedded in the organic binder; and setting the thickness of the UV-curable organic binder phosphor particulate layer to a predetermined desired thickness.

3. The method as defined in claim 2, further including the step of curing the UV-curable organic binder phosphor particulate layer prior to the step of laminating the front and rear electrode laminates.

4. The method as defined in claim 2, further including the step of partially curing the UV-curable organic binder phosphor particulate layer prior to setting the thickness of the layer.

5. The method as defined in claim 1, wherein the step of providing a front electrode laminate includes the steps of:

applying a slurry mixture of a UV-curable organic binder and phosphor particulate to the ITO surface of the ITO/PET film; and setting the thickness of the UV-curable organic binder and phosphor particulate layer to a predetermined desired thickness.

6. The method as defined in claim 5, further including the step of curing the UV-curable organic binder phosphor particulate layer prior to the step of laminating the front and rear electrode laminates.

7. The method as defined in claim 5, further including the step of curing the UV-curable organic binder phosphor particulate layer after the step of laminating the front and rear electrode laminates.

8. The method as defined in claim 1, wherein the step of continuously joining said front and rear electrode laminates further includes embedding exposed portions of the phosphor particulate extending beyond the surface of the organic binder in the barium titanate layer.

9. The method as defined in claim 1, wherein the step of continuously joining said front and rear electrode laminates further includes setting the thickness of the EL lamp laminate material to a predetermined desired thickness.

10. The method as defined in claim 1, wherein the step of providing a front electrode laminate includes the steps of:

applying a thermoplastic clear organic binder to the ITO surface of the ITO/PET film;

setting the thickness of the thermoplastic clear organic binder layer to a predetermined desired thickness;

warming the thermoplastic organic binder layer to soften it;

electrostatically depositing a mono-layer of phosphor particulate on the softened thermoplastic organic binder surface; and chilling the thermoplastic organic binder phosphor particulate layer to firm it prior to the step of joining the front and rear electrode laminates.

11. Apparatus for continuously manufacturing electroluminescent (EL) lamp material comprising:

a first roller for applying an organic binder to the indium tin oxide (ITO) surface of a continuous coil of an indium tin oxide polyester (ITO/PET) film;

a phosphor particulate deposition station for depositing a mono-layer of phosphor particulate on said organic binder, said phosphor particulate organic binder coated ITO/PET film defining a front electrode laminate;

a second roller for applying a barium titanate layer to the aluminum foil surface of a continuous coil of an aluminum foil polyester film, said barium titanate coated aluminum foil polyester film defining a rear electrode laminate; and a laminating nip for joining said front electrode laminate and said rear electrode laminate passing through said nip with said organic binder phosphor particulate layer facing said barium titanate layer to produce a continuous roll of EL lamp laminate material having an ITO front electrode and an aluminum foil rear electrode.

12. The apparatus as defined in claim 11, wherein said first roller further comprises a gravure roller for applying the organic binder layer to the ITO surface.

13. The apparatus as defined in claim 11, wherein said first roller applies a UV-curable organic binder layer to the ITO surface.

14. The apparatus as defined in claim 13, wherein said phosphor particulate deposition station further comprises a phosphor particulate deposition station electrostatic depositing means.

15. The apparatus as defined in claim 11, further including a calender roll for setting the thickness of said front electrode laminate to a predetermined desired thickness.

16. The apparatus as defined in claim 11, wherein said first roller further comprises a knife-over-roll apparatus for applying a slurry mixture of a UV-curable organic binder and phosphor particulate to the ITO surface of the ITO/PET film.

17. The apparatus as defined in claim 13, further including a UV-organic binder curing station located prior to said laminating nip.

18. The apparatus as defined in claim 13, further including a UV-organic binder curing station located after said laminating nip.

19. The apparatus as defined in claim 11, wherein said laminating nip comprises a pressure-nip laminator.

20. The apparatus as defined in claim 11, wherein said laminating nip comprises a heated-nip laminator.

21. Method for continuously manufacturing electroluminescent (EL) lamp material comprising the steps of:

providing a front electrode laminate comprising the steps of:

providing a continuous roll of an indium tin oxide coated polyester (ITO/PET) film of indeterminate length and width;

applying a UV-curable organic binder to the indium tin oxide (ITO) surface of the ITO/PET film by means of a roller;

depositing a mono-layer of phosphor particulate onto the UV-curable organic binder layer;

partially curing the phosphor particulate deposited UV-curable organic binder layer;

setting the UV-curable organic binder phosphor particulate layer to a predetermined desired thickness; and curing the UV-curable organic binder phosphor particulate particulate layer;

providing a rear electrode laminate comprising the steps of:

providing a continuous roll of an aluminum foil polyester film of indeterminate length and having a width substantially equal to the width of the ITO/PET film;

applying a layer of barium titanate to the aluminum foil surface of the aluminum foil polyester; and continuously joining said front electrode laminate and said rear electrode laminate with said organic binder phosphor particulate layer facing said barium titanate layer to produce a continuous roll of EL lamp laminate material having an ITO front electrode and an aluminum foil rear electrode.

22. The method as defined in claim 21, further including the step of removing foreign matter from the indium tin oxide (ITO) surface prior to applying the UV-curable organic binder layer.

23. The method as defined in claim 21, wherein the step of the UV-curable organic binder further includes applying the UV-curable organic binder using a direct gravure roller.

24. The method as defined in claim 21, wherein the step of applying the UV-curable organic binder layer further includes applying the UV-curable organic binder using an indirect gravure roller.

25. The method as defined in claim 21, wherein the step of applying the UV-curable organic binder further comprises applying the UV-curable organic binder in a thickness in the range of about 0.3 mils to 0.8 mils.

26. The method as defined in claim 21, wherein the step of depositing a mono-layer of phosphor particulate further includes the step of electrostatically depositing phosphor particulate of like electrical polarity charge onto the surface of the UV-curable organic binder.

27. The method as defined in claim 26, further including discharging the electrical charge from the phosphor particulate electrostatically deposited on the UV-curable organic binder surface.

28. The method as defined in claim 26, wherein the step of depositing a mono-layer of phosphor particulate further includes depositing phosphor particulate having a microencapsulated inorganic coating.

29. The method as defined in claim 28, wherein the microencapsulated inorganic coating is aluminum oxide.

30. The method as defined in claim 28, wherein the microencapsulated inorganic coating is aluminum nitride.

31. The method as defined in claim 21, wherein the step of setting the thickness of the UV-curable organic binder phosphor particulate layer further includes passing the partially cured organic binder phosphor particulate layer ITO/PET film through at least one calender roll.

32. The method as defined in claim 31, further including the step of heating the calender roll to soften the partially cured UV-curable organic binder to more easily reposition the phosphor particulate.

33. The method as defined in claim 21, wherein the step of applying the UV-curable organic binder further comprises applying a clear, UV-curable organic binder.

34. The method as defined in claim 32, wherein the UV-curable organic binder is moisture resistant.

35. The method as defined in claim 33, wherein the UV-curable organic binder has a dielectric constant in the range of about greater than 4, a dissipation factor in the range of about less than 0.125, and a dielectric strength in the range of about 1000 +/−200 volts per mil.

36. The method as defined in claim 21, wherein the step of continuously joining the front and rear electrode laminates further comprises passing the front and rear electrode laminates through a nip laminator.

37. The method as defined in claim 36, further comprising the step of heating the nip laminator.

38. The method as defined in claim 21, further comprising the steps of:

cutting the rear electrode laminate into at least one pair of parallel strips; and continuously joining said front electrode laminate and said parallel strip pair of rear electrode laminate to produce a continuous roll of split-electrode EL lamp laminate material.

39. The method as defined in claim 21, further comprising the steps of:

cutting the rear electrode laminate into at least two pairs of parallel strips;

continuously joining said front electrode laminate and said at least two pairs of parallel strips rear electrode laminate; and cutting the continuously joined front and rear electrode laminate along a line defined by adjacent pairs of parallel strips of rear electrode laminate to produce continuous rolls of split-electrode EL lamp laminate material wherein each continuous roll corresponds to each pair of parallel rear electrode laminate strips.

40. An electroluminescent (EL) lamp material comprising:

a front electrode laminate comprising:

a continuous coil of indium tin oxide coated polyester (ITO/PET) film;

an organic binder layer on the indium tin oxide surface of said ITO/PET film, and a mono-layer of phosphor particulate on said organic binder layer;

a rear electrode laminate comprising:

a continuous coil of an aluminum foil polyester film;

a barium titanate layer on the aluminum foil surface of said aluminum foil polyester film; and wherein said front electrode laminate and said rear electrode laminate are continuously joined with said organic binder phosphor particulate layer facing said barium titanate layer to form a continuous roll of EL lamp laminate material having an ITO front electrode and an aluminum foil rear electrode.

41. The EL lamp material as defined in claim 40, wherein said organic binder is a UV-curable organic binder.

42. The EL lamp material as defined in claim 40, wherein said EL lamp material further comprises said rear electrode being cut to a predetermined depth through said aluminum foil polyester film and partially into said barium titanate layer to produce at least two electrically isolated rear electrode areas defining a continuous roll of a split-electrode EL lamp.

43. The EL lamp material as defined in claim 42, further comprising said rear electrode being cut to a predetermined depth through said aluminum foil polyester film and partially into said barium titanate layer to produce at least two electrically isolated rear electrodes of equal area defining a continuous roll of a split-electrode EL lamp wherein each area emits light of substantially equal brightness.

44. The EL lamp material as defined in claim 42, further comprising said rear electrode being cut to a predetermined depth through said aluminum foil polyester film and partially into said barium titanate layer to produce at least two electrically isolated rear electrodes of unequal area defining a continuous roll of a split-electrode EL lamp wherein each area emits light of unequal brightness.

45. The EL lamp material as defined in claim 42, further comprising said rear electrode having multiple cuts to a predetermined depth through said aluminum foil polyester film and partially into said barium titanate layer to produce multiple pairs of electrically isolated rear electrode areas defining a continuous roll of a split-electrode EL lamp wherein light is emitted in the area of each pair of multiple pairs to produce special effect lighting.

46. The EL lamp material as defined in claim 42, further comprising each of said at least two electrically isolated rear electrode areas having an electrical connector in contact with said aluminum foil for powering the EL lamp.

47. The EL lamp material as defined in claim 40, wherein said EL lamp material further comprises said laminate having dual scribe lines along a marginal peripheral region cut to predetermined depths through said laminate, wherein the first scribe line of said dual scribe lines is outward of the second scribe line of the dual scribe lines and is cut completely through said rear electrode laminate and said phosphor particle organic binder layer terminating at said indium tin oxide layer, and the second of said dual scribe lines cut to a predetermined depth through said aluminum foil polyester film and partially into said barium titanate layer to produce a parallel-plate EL lamp.

48. The EL lamp material as defined in claim 47, wherein the laminate region between the first scribe line and the laminate outer peripheral edge further includes an electrical connector through said laminate and in electrical contact with said indium tin oxide for powering said front electrode defining one plate of the parallel plate EL lamp.

49. The EL lamp material as defined in claim 47, wherein the laminate region between the second scribe line and the laminate outer peripheral edge opposite said laminate outer peripheral edge outward of said first scribe line further includes an electrical connector through said laminate and in electrical contact with said aluminum foil for powering said rear electrode defining the other plate of the parallel plate EL lamp.

50. The EL lamp material as defined in claim 47, further comprising said first scribe line being flooded with a conductive material.

51. The EL lamp material as defined in claim 41 wherein said UV-curable organic binder phosphor particulate layer is set to a predetermined thickness.

52. The EL lamp material as defined in claim 42 wherein said continuous roll of said split-electrode EL lamp material is cut to provide an EL lamp having a desired size and shape.

* * * * *